United States Patent [19]

Honjo et al.

[11] Patent Number: 4,849,787

[45] Date of Patent: Jul. 18, 1989

[54] ORIGINAL HANDLING APPARATUS

[75] Inventors: Takeshi Honjo, Kawasaki; Shunji Sato, Tokyo, both of Japan

[73] Assignee: Canon Kabushiki Kaisha, Tokyo, Japan

[21] Appl. No.: 265,347

[22] Filed: Oct. 28, 1988

Related U.S. Application Data

[63] Continuation of Ser. No. 49,970, May 15, 1987, abandoned.

[30] Foreign Application Priority Data

| | | | |
|---|---|---|---|
| May 20, 1986 | [JP] | Japan | 61-115103 |
| May 20, 1986 | [JP] | Japan | 61-115104 |
| May 20, 1986 | [JP] | Japan | 61-115105 |
| May 20, 1986 | [JP] | Japan | 61-115106 |
| May 20, 1986 | [JP] | Japan | 61-115107 |
| May 20, 1986 | [JP] | Japan | 61-115108 |
| May 20, 1986 | [JP] | Japan | 61-115109 |
| Jun. 9, 1986 | [JP] | Japan | 61-133571 |
| Jun. 9, 1986 | [JP] | Japan | 61-133572 |
| Jun. 9, 1986 | [JP] | Japan | 61-133574 |

[51] Int. Cl.[4] ..... G03G 15/00

[52] U.S. Cl. ..... 355/313; 355/3 SH; 355/7; 355/317; 355/218; 355/231

[58] Field of Search ..... 355/3 SH, 14 SH, 23, 355/24, 3 R, 14 R, 75, 7

[56] References Cited

U.S. PATENT DOCUMENTS 4,621,921 11/1986 Takahata et al. ..... 355/14 SH

FOREIGN PATENT DOCUMENTS

| | | | |
|---|---|---|---|
| 0023544 | 2/1981 | European Pat. Off. . | |
| 3626846 | 2/1987 | Fed. Rep. of Germany . | |
| 3626932 | 3/1987 | Fed. Rep. of Germany . | |
| 59-87470A | 5/1984 | Japan | 355/7 |
| 59-88754 | 5/1984 | Japan . | |

*Primary Examiner*—A. C. Prescott

*Attorney, Agent, or Firm*—Fitzpatrick, Cella, Harper & Scinto

[57] ABSTRACT

An original handling apparatus includes a digitizer for feeding an original to a predetermined position and allowing the operator pad to designate an arbitrary area of the original using a write pen and a two-dimensional electrode. The apparatus also includes an original (document) feeder for feeding the original to the predetermined position, and a selecting unit for selecting the digitizer or the original feeder. The selecting unit includes a sensor for detecting opening/closing of a digitizer cover. When the cover is open, the original is fed from the original feeder. When the cover is closed, the original is fed from the digitizer.

26 Claims, 15 Drawing Sheets

ORIGINAL HANDLING APPARATUS

This application is a continuation of application Ser. No. 049,970 filed May 15, 1987, now abandoned.

BACKGROUND OF THE INVENTION

FIELD OF THE INVENTION

The present invention relates to an original handling apparatus for feeding an original to a predetermined position.

In an image formation apparatus such as a copying machine, an original handling apparatus is often attached to feed an original to a predetermined position such as an exposure position.

In recent years, image formation apparatuses such as copying machines have a new function wherein a given portion of an original is designated, only a designated portion is extracted or omitted, and the extracted portion or the remaining portion excluding the extracted portion is copied. For this purpose, there is provided an apparatus for inputting X- and Y-coordinates at the time of designation or an apparatus using a known digitizer to designate the copying area.

Conventional digitizers are mounted on the upper portions of press plates on platen glass plates of copying machines. In such a conventional digitizer, an operator must manually open the press plate and must place an original on the platen glass plate after using the digitizer, resulting in inconvenience.

When a conventional original handling apparatus is attached to a copying machine, no area is assured for mounting a digitizer on the copying machine. For example, the digitizer is placed on a separate stand. Then, the operator must replace the original in each copying cycle. In addition, the overall system becomes bulky.

SUMMARY OF THE INVENTION

The present invention has been made in consideration of the above situation, and has as its object to provide a new and improved original handling apparatus.

It is another object of the present invention to provide a simple original handling apparatus with good operability.

It is still another object of the present invention to provide a highly reliable original handling apparatus.

It is still another object of the present invention to provide an original handling apparatus capable of allowing an operator to designate a desired area of an original and feeding the original without bothering the operator.

The above and other objects, features, and advantages of the present invention will be apparent from the following descriptions in conjunction with the accompanying drawings.

BRIEF DESCRIPTION OF THE DRAWINGS

FIG. 2-B is a view showing an original image and a copied image;

DETAILED DESCRIPTION OF THE PREFERRED EMBODIMENTS

Figure 1:
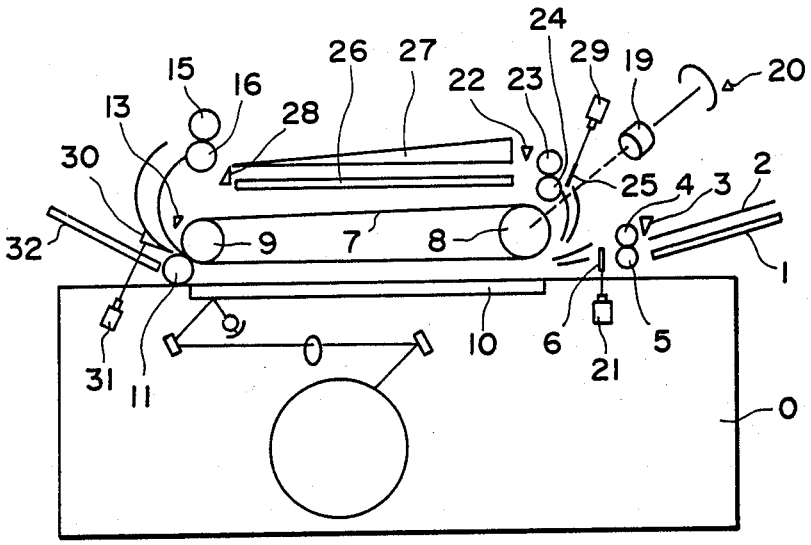
FIG. 1 is a schematic view showing a DF (Document Feeder) according to an embodiment of the present invention.

Preferred embodiments of the present invention will be described in detail with reference to the accompanying drawings. FIG. 1 is a schematic view of an original handling apparatus (to be referred to as a DF hereinafter) according to an embodiment of the present invention. A sheet-like original 2 is placed on an inlet tray 1. In this case, the image surface of the original 2 faces downward. A first original detection DF inlet sensor 3 comprises a reflecting sensor for detecting leading and trailing ends of the original 2. Feed rollers 4 and 5 are in rolling contact with each other, clamping the original 2 therebetween and feeding it. A stopper 6 prevents feeding of the original onto a platen glass plate 10. The stopper 6 is released upon operation of a DF inlet stopper solenoid 21 to allow feeding of the original 2. A belt 7 comprises an endless belt having a width enough to cover the entire surface of the sheet-like original 2. The outer surface of the endless belt 7 has a high frictional coefficient for transferring the original onto the glass plate 10. The endless belt 7 is looped between a drive roller 8 and a turn roller 9. In this case, slippage between the drive roller 8 and the inner surface of the endless belt 7 is prevented. A discharge roller 11 is in tight contact with the upper surface of the endless belt 7 to discharge the original from the glass plate 10. An original detection DF outlet sensor 13 comprises a reflecting sensor. When the sensor 13 detects the leading end of the original, the sensor 13 causes the endless belt 7 to temporarily stop and then travel again in the reverse direction. When the DF outlet sensor 13 detects the trailing end of the original, the original is stopped at a predetermined position when a predetermined period of time has elapsed.

A known digitizer 26 is mounted on the upper portion of the DF of the present invention. A digitizer cover 27 is placed to cover the entire surface of the digitizer 26. An opening/closing detection sensor 28 is arranged to detect opening or closing of the cover 27 and performs an important function for mode switching (to be described later). A digitizer feed port is formed at the upper right portion of the DF to feed the original to the digitizer. When the cover 27 is closed, the feed port is concealed. However, when the cover 27 is open, the feed port is exposed. A digitizer inlet sensor 22 is arranged at the digitizer feed port to detect the original placed on the upper surface of the digitizer. In this case, the inlet sensor 22 comprises a reflecting sensor. Feed rollers 23 and 24 are in rolling contact with each other to feed the sheet-like original.

A stopper 25 prevents feeding of the original from the digitizer original feed port onto the platen glass plate. The stopper 25 is released upon operation of a digitizer inlet stopper solenoid 29 and allows feeding of the original. The original inserted from the digitizer feed port and fed by the feed rollers 23 and 24 is fed onto the platen glass plate from the right end portion of the endless belt 7 along a guide plate.

All the rollers and the endless belt 7 are driven by a motor 19. A clock disk for generating clock pulses upon rotation of the motor 19 and a sensor 20 are arranged to control the operation of the DF. The discharge direction of the original discharged by the discharge roller 11 and the endless belt 7 upon completion of the exposure operation is switched by a discharge flapper 30. When a flapper SL (solenoid) 31 is turned on, the original is discharged in a discharge tray 32 disposed on the left side of the DF. In this manner, the originals are sequentially discharged on the discharge tray 32. However, when the flapper SL 31 is turned off, the flapper 30 is switched to the opposite side so that the original is clamped by discharge rollers 15 and 16. In this case, the originals are sequentially stacked on the digitizer cover 27.

Figure 2A:
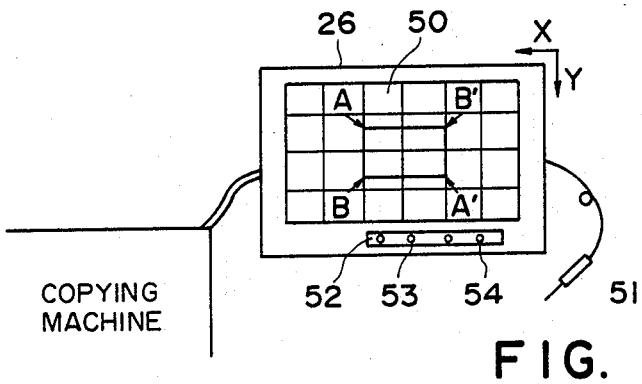
FIG. 2-A is a schematic view of a digitizer section.
Figure 2B:
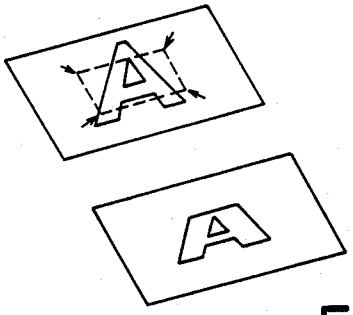

FIG. 2-A is a schematic view of the digitizer of the present invention. The digitizer comprises a sheet resistor 50 for reading an X-coordinate (transverse direction), another sheet resistor 50 for reading a Y-coordinate (vertical direction), and a read pen switch (SW) 51. The sheet resistors 50 extend below keys such as a clear key 52, a registration (reg.) key 53, and a continuation (cont.) designation key 54 as well as a sheet on which an original is placed. A voltage is output from a position designated by the pen SW 51 and is used as an area setting value together with operations of the above keys.

The operator places an original on the sheet resistors 50 while the original is faced up. In this case, the upper right corner of the original serves as a reference point. The operator then depresses two points, e.g., points A and A' or B and B' with the pen SW 51 to designate an area defined by points A, B', A' and B. The operator depresses the reg. key 53 with the pen SW 51 to designate the area. For example, trimming or image conversion can be performed in the copying mode. A copy as shown in FIG. 2-B can be obtained.

Figure 3:
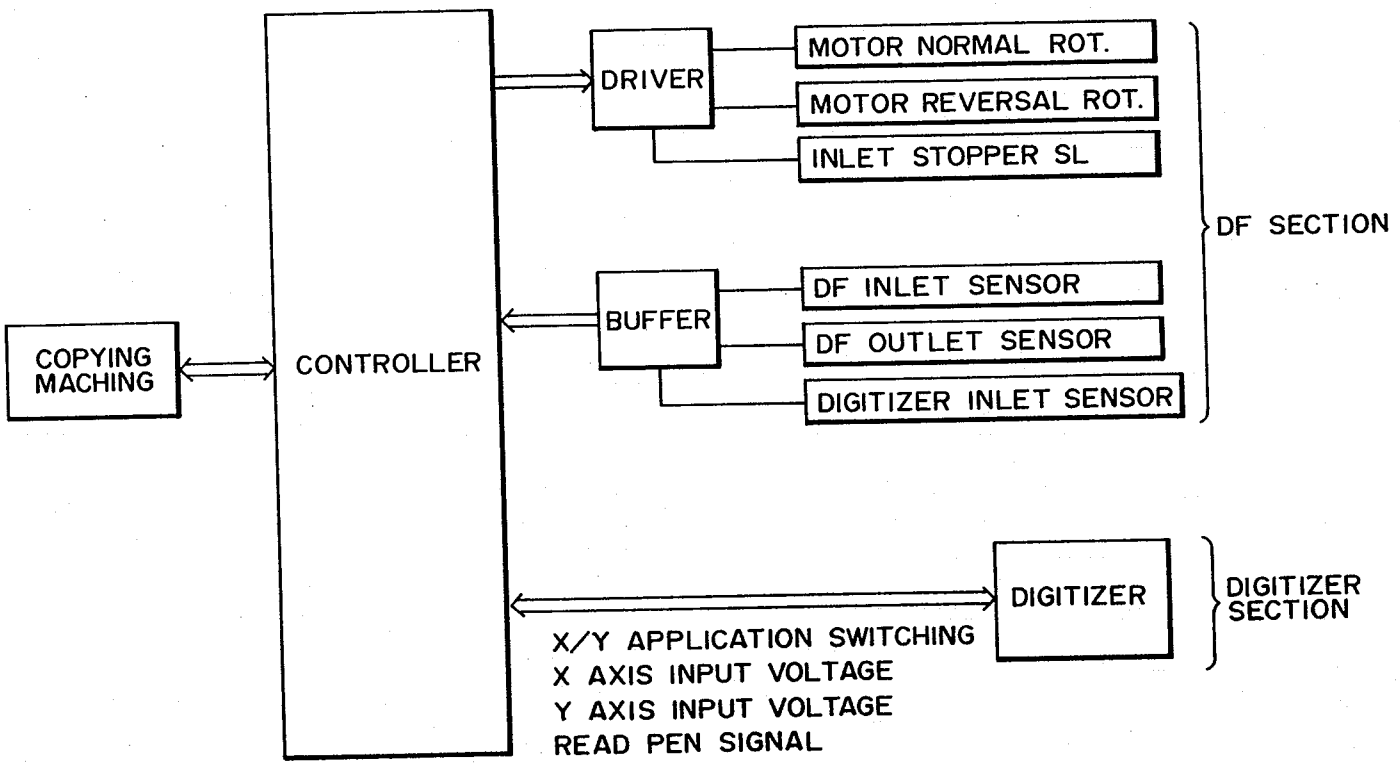
FIG. 3 is a block diagram of a control section for a copying machine and the DF.

FIG. 3 is a block diagram of a control section for the DF and the copying machine. The control section includes a controller which comprises a microcomputer. The microcomputer accesses a RAM I/O in accordance with programs stored in a ROM therein. Signals input to the DF section through a driver are used for control motor normal rotation, motor reversal rotation, and ON/OFF operations of a DF inlet stopper SL, a digitizer inlet stopper SL, and a discharge flapper SL. Signals input to the controller through a buffer are output signals from a DF inlet sensor, a DF outlet sensor, a digitizer inlet sensor, and a digitizer opening/closing sensor as well as a clock pulse signal. An X/Y application switching signal is supplied from the controller to the digitizer to switch a voltage applied to the digitizer electrodes. If the switching signal is set at "L" level, the signal serves as an X axis input voltage. However, if the switching signal is set at "H" level, it serves is a Y axis input voltage. Signals input to the controller are a read pen signal enabled upon depression of the digitizer electrode surface with a read pen, an X axis input voltage signal as an analog signal generated at a depressed position in the X direction, and a Y axis input voltage signal as an analog signal generated at a depressed position in the Y direction. The controller shown in FIG. 3 exchanges input/output signals with respect to control sections of the copying machine.

Figures 4, 4B:
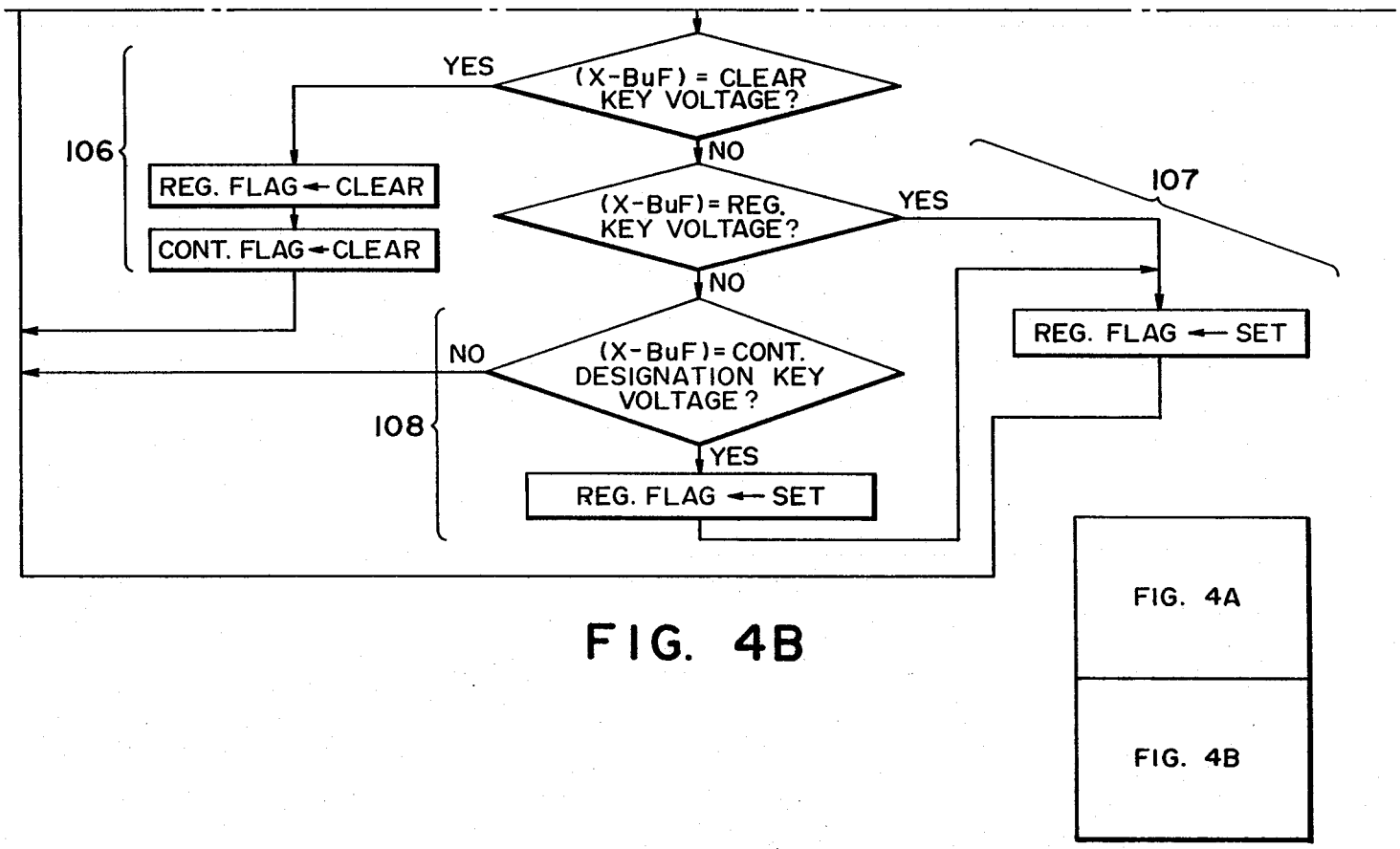
FIG. 4 is a flow chart for explaining digitizer setting.
Figure 4A:
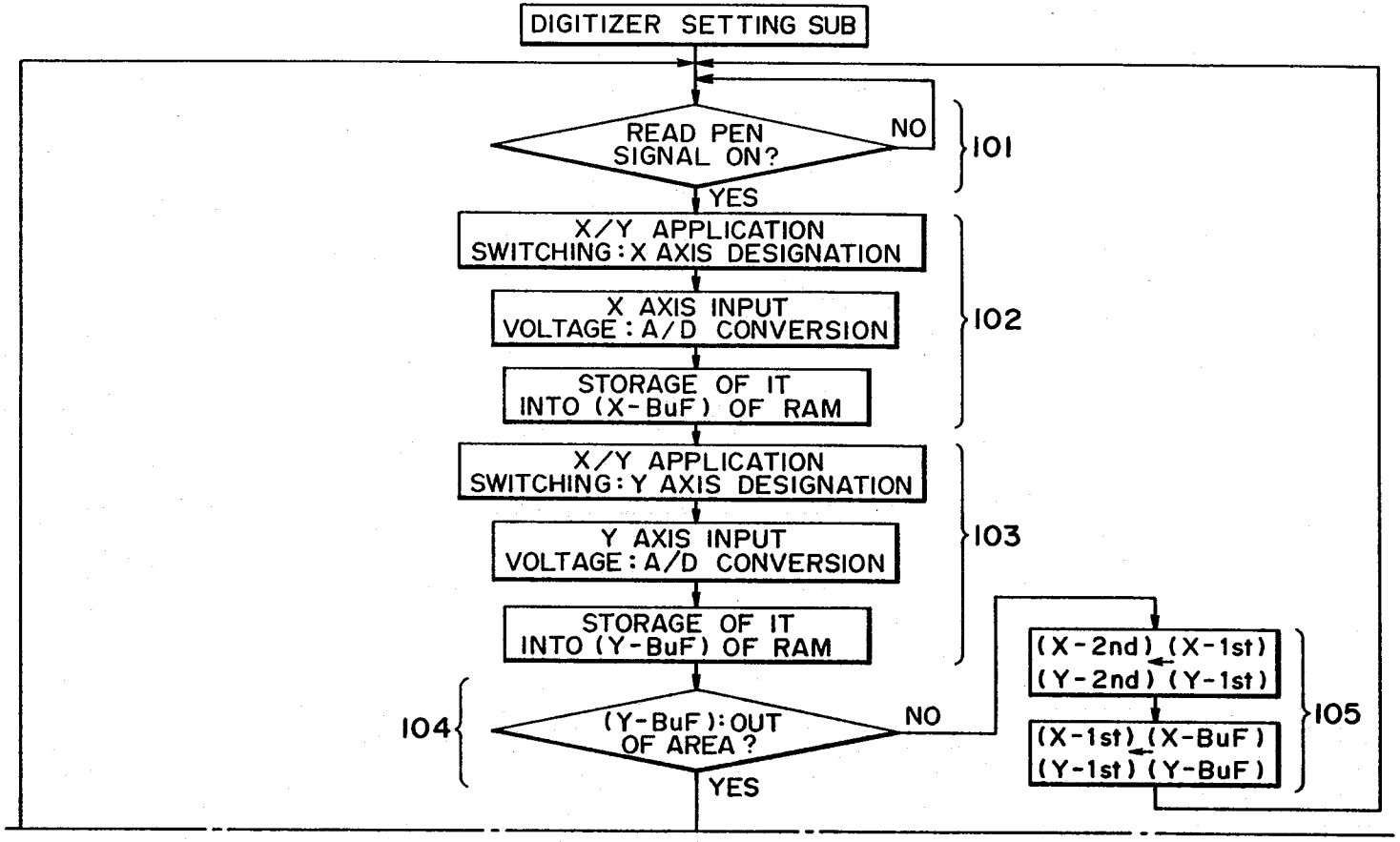

FIG. 4 is a flow chart for explaining digitizer setting. As described above, when the operator depresses the read pen on the digitizer electrode surface to designate an area, the controller waits for enabling of the read pen signal generated upon detection of depression of the read pen 51 (step 101). When the read pen signal is enabled and input to the controller, the controller sets the voltage applied to the electrode to be an X axis designation voltage. The X axis designation voltage representing the X-coordinate is A/D-converted, and the digital signal is stored in the X-BuF in the RAM (step 102). The application voltage is changed for Y axis designation. In the same manner as described above, the resultant digital signal is stored in the Y-BuF in the RAM (step 103). The stored data in the Y-BuF is compared with the maximum value of a predetermined area to determine whether the position represented by the stored data falls outside the predetermined area (step 104). If NO in step 104, the contents of the X-1st and the Y-1st are shifted to the memory area at the X-2nd and Y-2nd data addresses in the RAM. The currently fetched X-BuF and Y-BuF data are shifted to the memory area at the X-1st and Y-1st addresses, thereby refreshing the coordinates of the designated area. In this manner, only coordinates of two points are stored. Even if the coordinates are sequentially designated, the most recent data are always stored in the RAM. However, if YES in step 104, the controller determines in step 106 whether the data is input from a mode setting key. More specifically, in step 106, the X-BuF data is compared with a clear key voltage value. If YES in the decision block, the reg. and cont. flags are cleared. In step 107, the Y-BuF data is compared with a reg. key voltage value. If the data is equal to the voltage value, the reg. flag is set. Digitizer area designation is completed upon depression of the dig. key. The controller determines according to the reg. flag in the copy start time whether a digitizer area is designated.

In step 108, the X-BuF data is compared with a cont. designation key voltage value. If the data is equal to the voltage value, the cont. and reg. flags are set (to be described later).

Figure 5B:
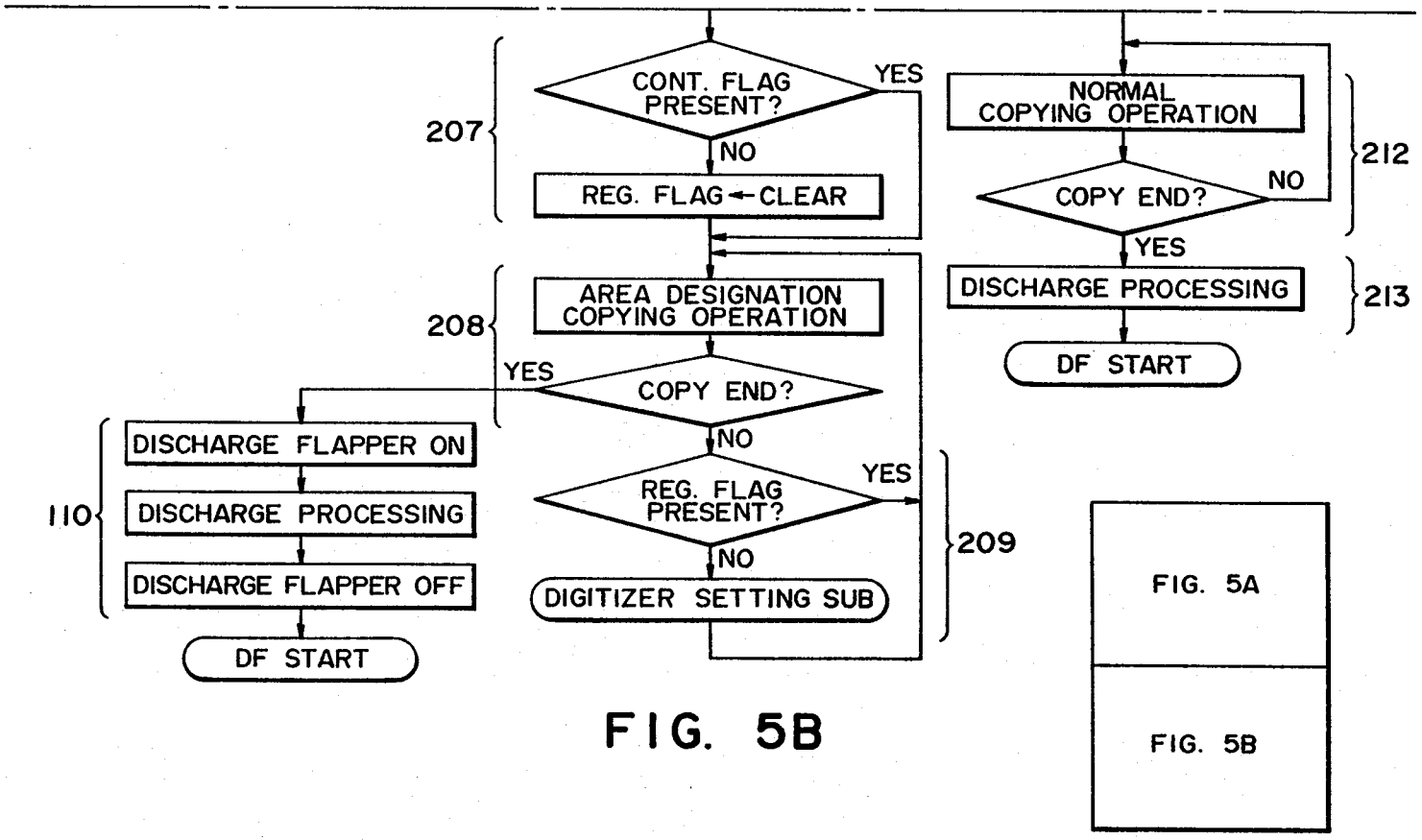
FIG. 5 is a flow chart for explaining control operation of the DF.
Figure 5A:
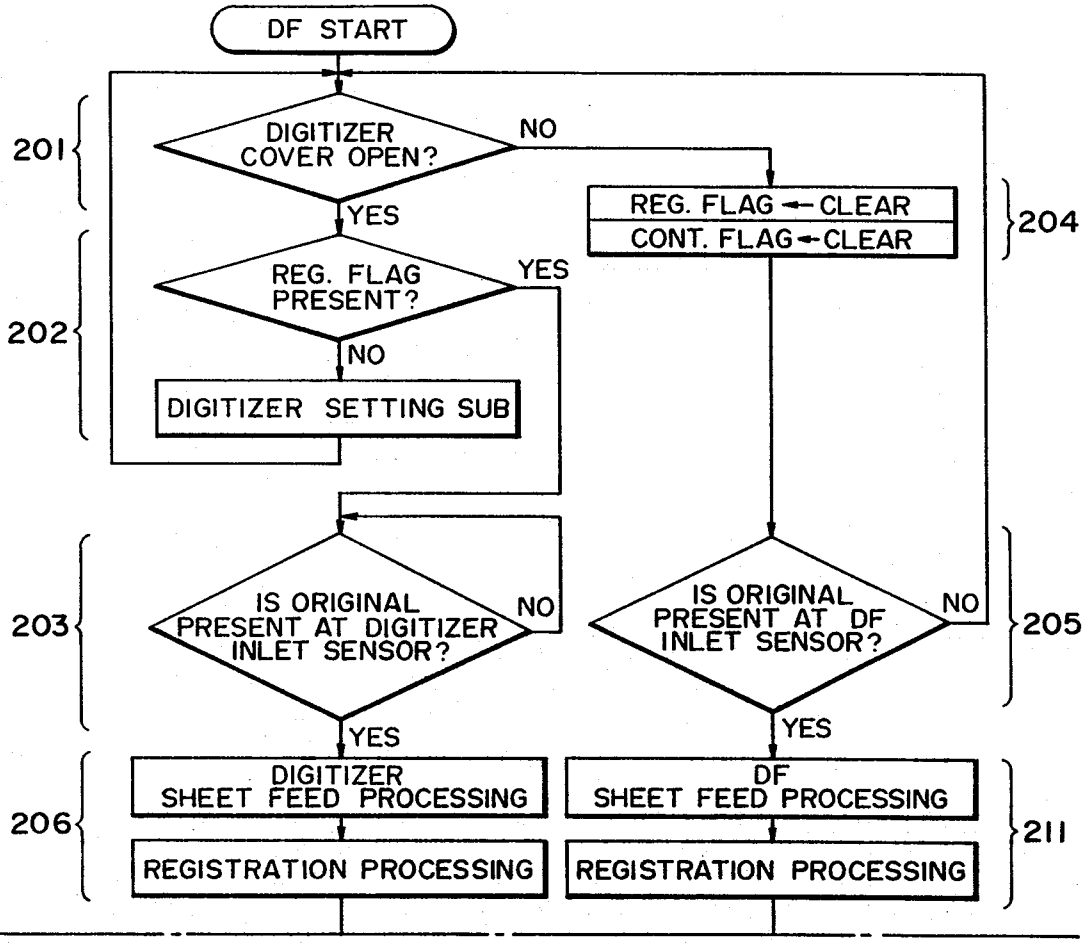

FIG. 5 is a flow chart for explaining the detailed operation of the DF according to this embodiment. Opening or closing of the digitizer cover of the DF is detected. By this detection, the controller determines in step 201 whether the digitizer mode or DF mode is set. If the controller determines in step 201 that the digitizer cover is open, i.e., if YES in step 201, the digitizer mode is set and the flow advances to step 202. At this time, the controller is ready for receiving digitizer setting. Until the reg. flag is set, the controller performs digitizer setting SUB (subroutine). When digitizer setting is completed, the controller determines in step 203 whether the original is present at the digitizer inlet sensor. Original feeding is inhibited unless digitizer setting is completed (step 203).

When the digitizer cover is determined in step 201 to be closed the normal DF mode is set. In this case, the flow advances to step 204. The reg. and cont. flags are cleared. This operation provides a clearing function equivalent to clear key depression in the cover open state so as to clear digitizer setting. The controller determines in step 205 whether the original is set at the DF inlet sensor. If YES in step 205, feeding of the original is initiated. The decision in step 201 allows selection of only the digitizer feed portion when only the digitizer cover is open or only the DF feed port when the cover is closed. With this function, if the user wishes to use, e.g., a digitizer, the sequence of cover opening, digitizer setting, and original feeding can be smoothly performed.

Feeding in each mode is started. For example, in the digitizer mode, digitizer feed processing and registration processing are performed in step 206. In this case, the original is fed from the digitizer feed port and is stopped at a predetermined position on the platen glass plate. However, in the DF mode, DF feed processing and registration processing are performed in step 211. In this case, the original is fed from the DF feed port and is stopped on the platen glass plate.

Thereafter, copying operation is performed. Area designation copying is performed in the digitizer mode (step 208). However, in the DF mode, normal copying is performed (step 212). In particular, in the digitizer mode, the reg. flag is temporarily cleared (step 207) and area designation copying is started. Since original feeding is allowed until the reg. flag is set in step 202 (i.e., assuming one digitizer setting cycle is normally required for one original), original feeding and hence an operation error is prevented when the user forgets to set the area of the next original. The controller waits for completion of copying in step 208. In step 209, digitizer setting SUB is performed until the reg. flag is set, thereby allowing setting of area designation. This indicates that the next area designation can be performed during copying. Unlike in the conventional arrangement wherein area designation is accepted in only the standby state, the function and total efficiency of copying can be greatly improved. When the cont. flag is set by the cont. designation key, the area is continuously designated. More specifically, in step 207, if the cont. flag is set, the reg. flag is not cleared. Therefore, new digitizer setting is inhibited during copying in step 209, and thus the above operation can be performed. The cont. flag is cleared by closing the digitizer cover (step 204) or depression of the clear key (step 106).

Figure 6:
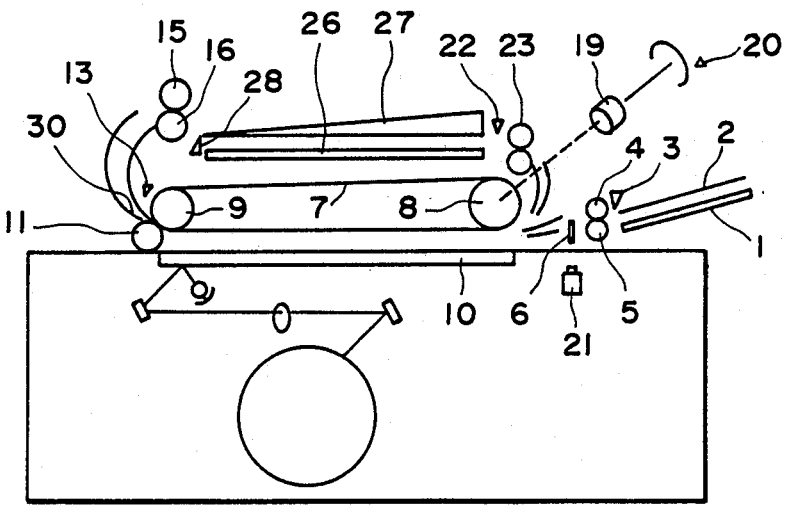
FIG. 6 is a schematic view showing a DF according to another embodiment of the present invention.

FIG. 6 is a schematic view of an original handling apparatus according to another embodiment of the present invention. As compared with the embodiment shown in FIG. 1, a stopper is not disposed at the digitizer feed port. In addition, only one original discharge tray is provided. Other arrangements in FIG. 6 are the same as those in FIG. 1, and a detailed description thereof will be omitted.

In a system wherein a digitizer shown in FIG. 6 is integrally mounted on the upper surface of the original feed apparatus, and a separate digitizer feed port is formed independently of the feed rollers of the original feed apparatus, the different feed ports must be used in the digitizer and non-digitizer modes, resulting in inconvenience.

In addition, if the operator erroneously sets originals in two feed ports, the originals may be damaged or be undesirably left in the DF.

Figures 7, 7B:
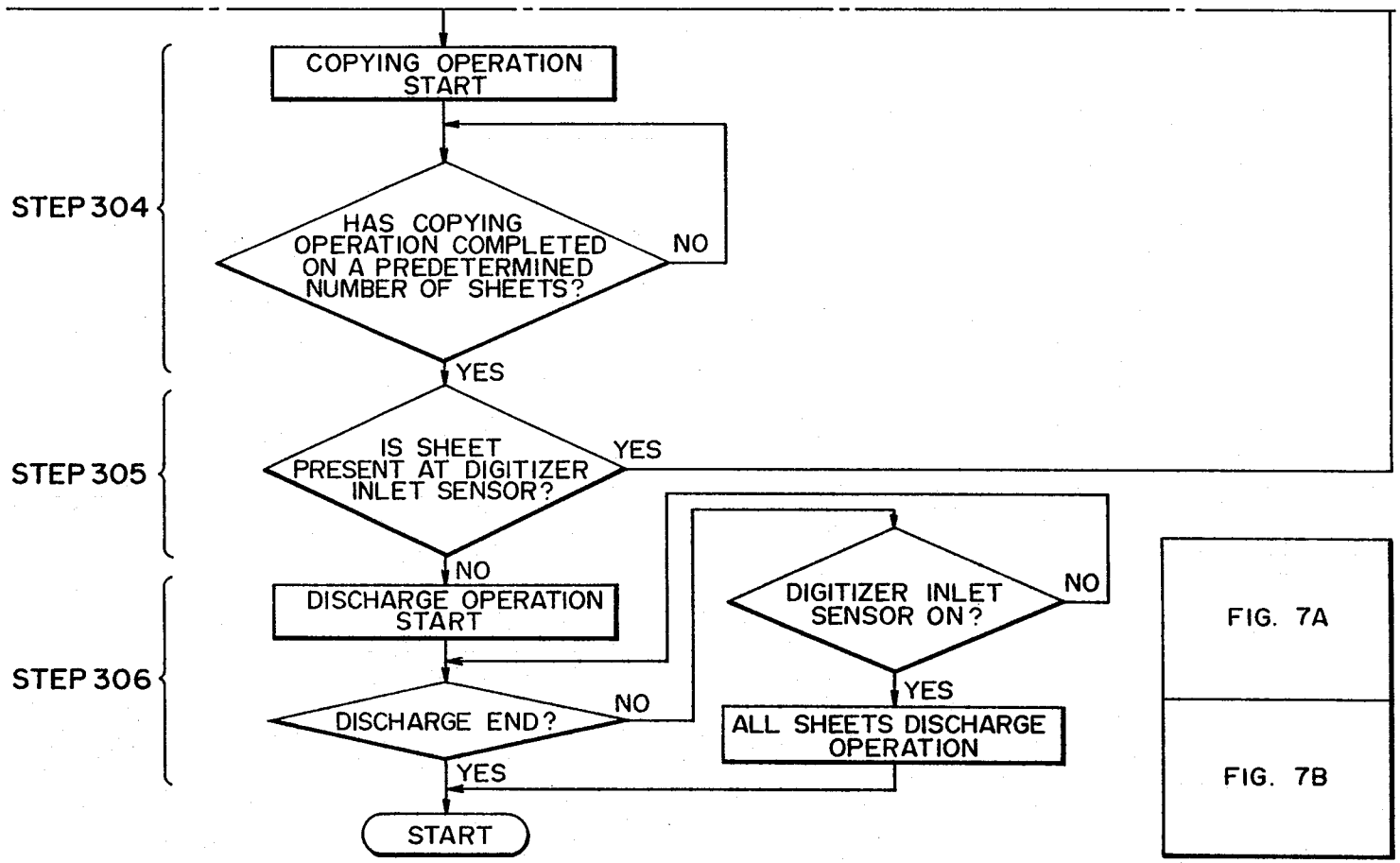
FIGS. 7 and 8 are flow charts for explaining the operation of the DF shown in FIG. 6.
Figure 7A:
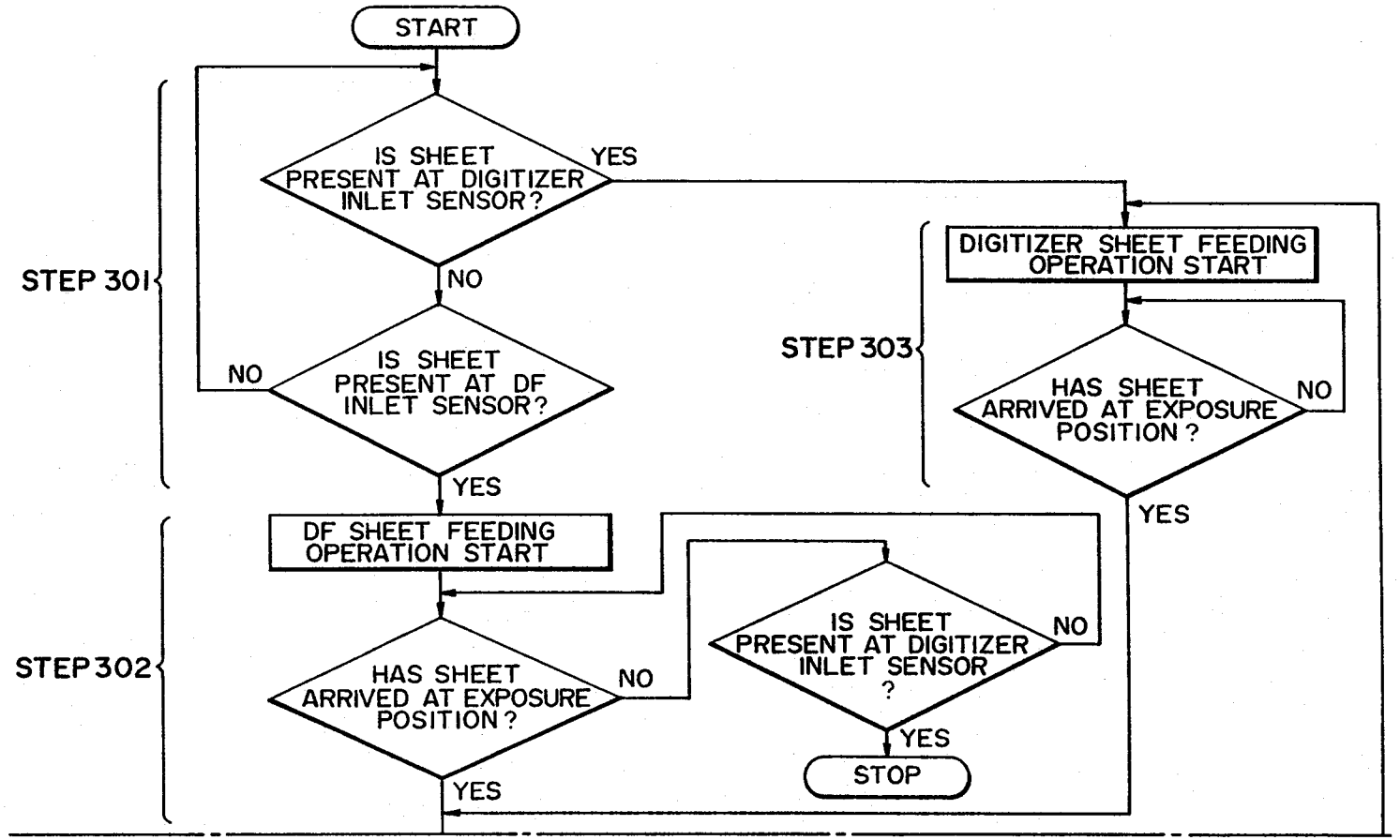

FIG. 7 is a flow chart for eliminating the above disadvantages.

The controller checks outputs from an inlet sensor 22 at the digitizer feed port without a stopper and an inlet sensor 3 at the DF feed port with a stopper in step 301. If the operator simultaneously sets the originals at the sensors 22 and 3, the sensor 22 has a priority over the sensor 3, thereby initiating feeding of the digitizer in step 303. The original is fed first from the feed port without a stopper. Feeding from the feed port from the stopper is awaited. However, if the original is present in only the DF inlet port, DF feeding is started in step 302.

The controller determines in step 302 whether the sheet is set at the digitizer inlet sensor 22 during feeding to the exposure position. If YES in step 302, feeding is interrupted. This sequence is provided to prevent feeding of the original from the digitizer feed port without a stopper when the operator erroneoulsy sets a sheet thereat. Therefore, feeding is interrupted upon detection of the presence of the original in the digitizer feed port, thereby preventing damage to the sheet.

When the sheet reaches the exposure position in steps 302 and 303, copying is started in step 304. The controller then waits until copying operation has been completed on a predetermined number of sheets.

When copying is completed, the sheet-like original is normally discharged. In this embodiment, the flow advances to step 305. The subsequent operation is determined according to the fact whether the sheet is set in the digitizer feed port without a stopper. More specifically, if the discharge operation is performed although the sheet is present, the sheet may be pulled to a wrong position. However, by starting the next feed cycle, the previous sheet is also normally discharged.

In the copying operation, if the sheet is not present at the digitizer inlet, the flow advances to step 306 and discharging is started. The controller determines in this step whether the next sheet is to be set at the digitizer feed port during the discharge operation of the previous sheet. If YES in step 306, the next sheet is also discharged. This operation prevents the following failure. When the next sheet is set while the previous sheet is being discharged, the next sheet is always pulled and is left in the DF, as described above, thus causing an operation failure. In order to prevent such a failure, all the sheets are discharged. Although processing may be assumed wherein the operation is immediately interrupted when the next sheet is set, the sheet is undesirably left in the DF instead of damaging the sheet. According to the method of this embodiment, such failures do not occur.

In the above embodiment, the original discharged from the original feed apparatus may be fed back into the apparatus.

Figures 8, 8B:
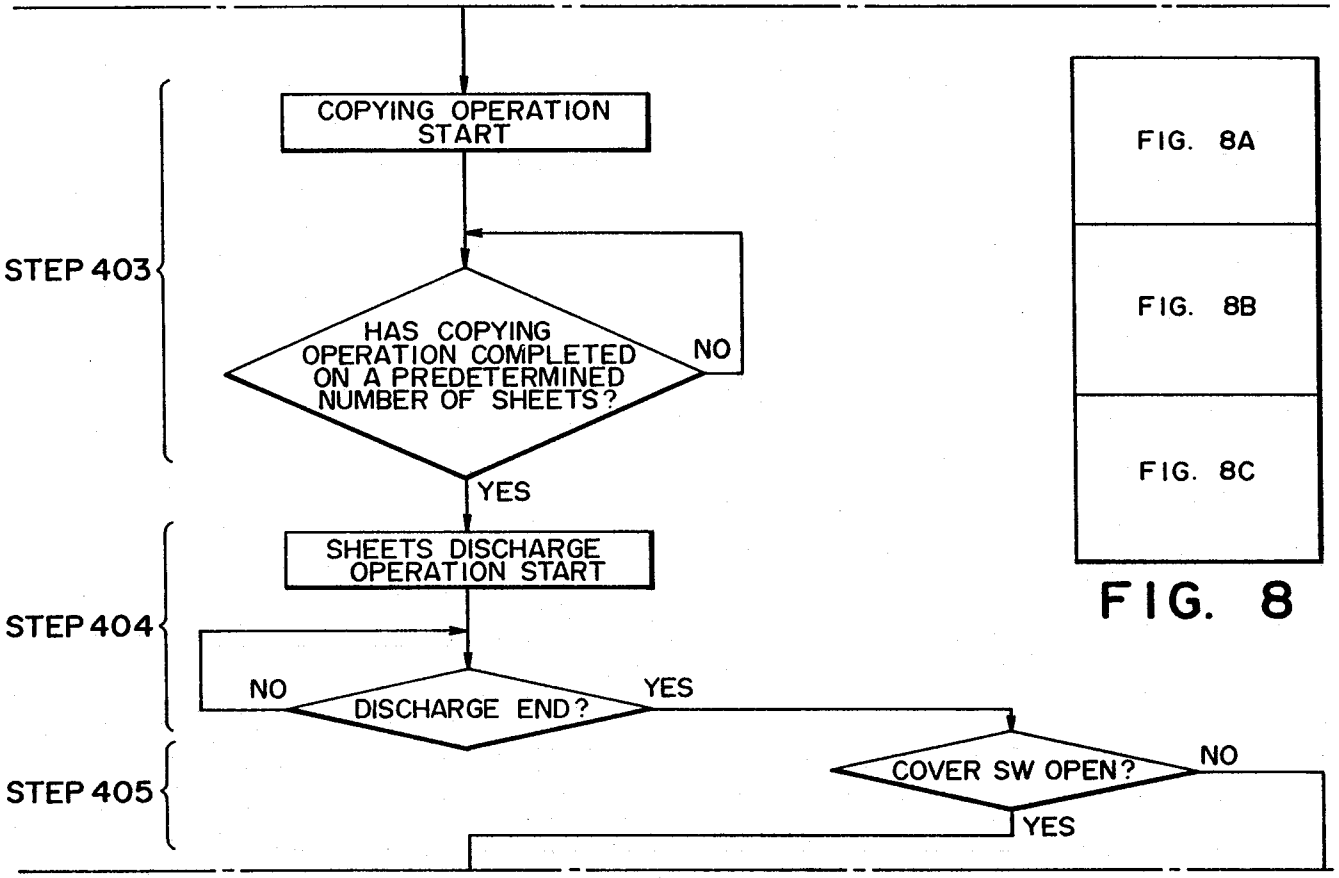
Figure 8A:
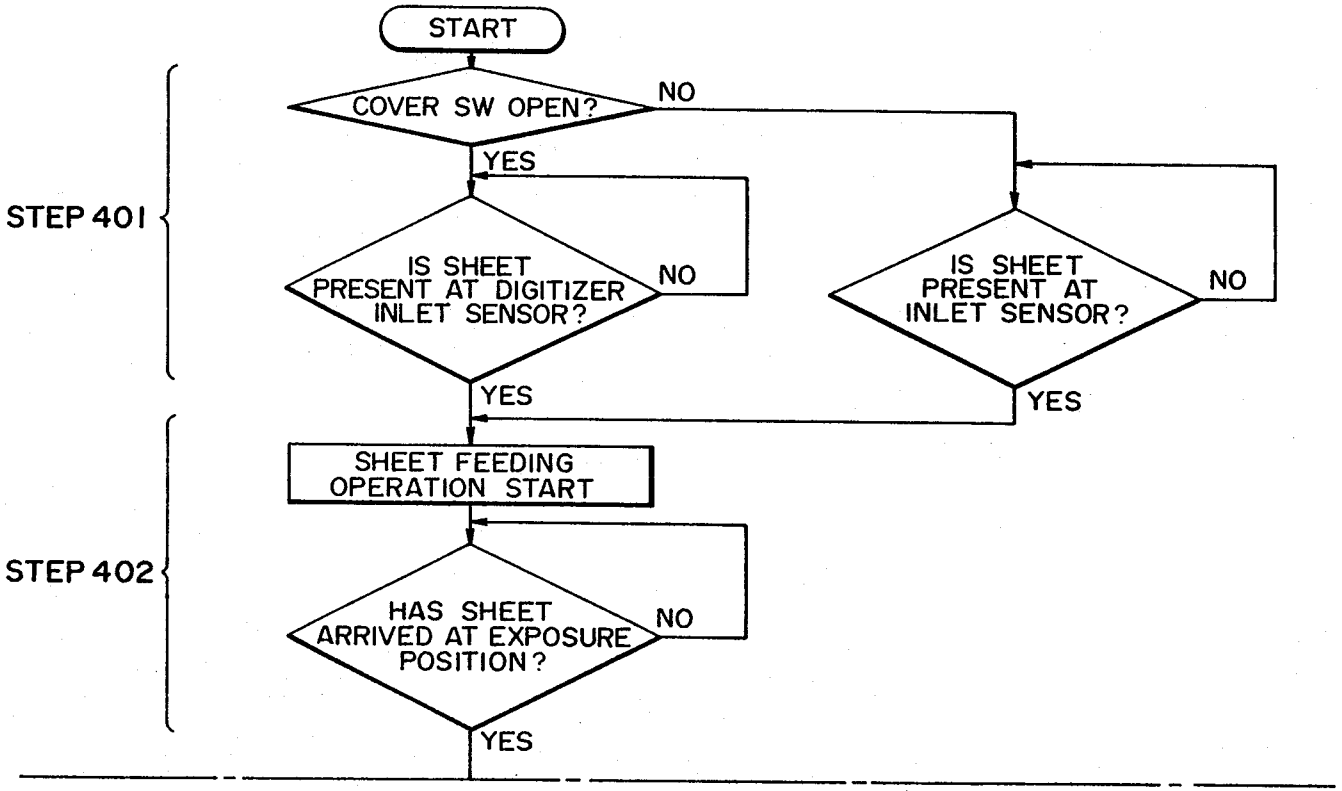
Figure 8C:
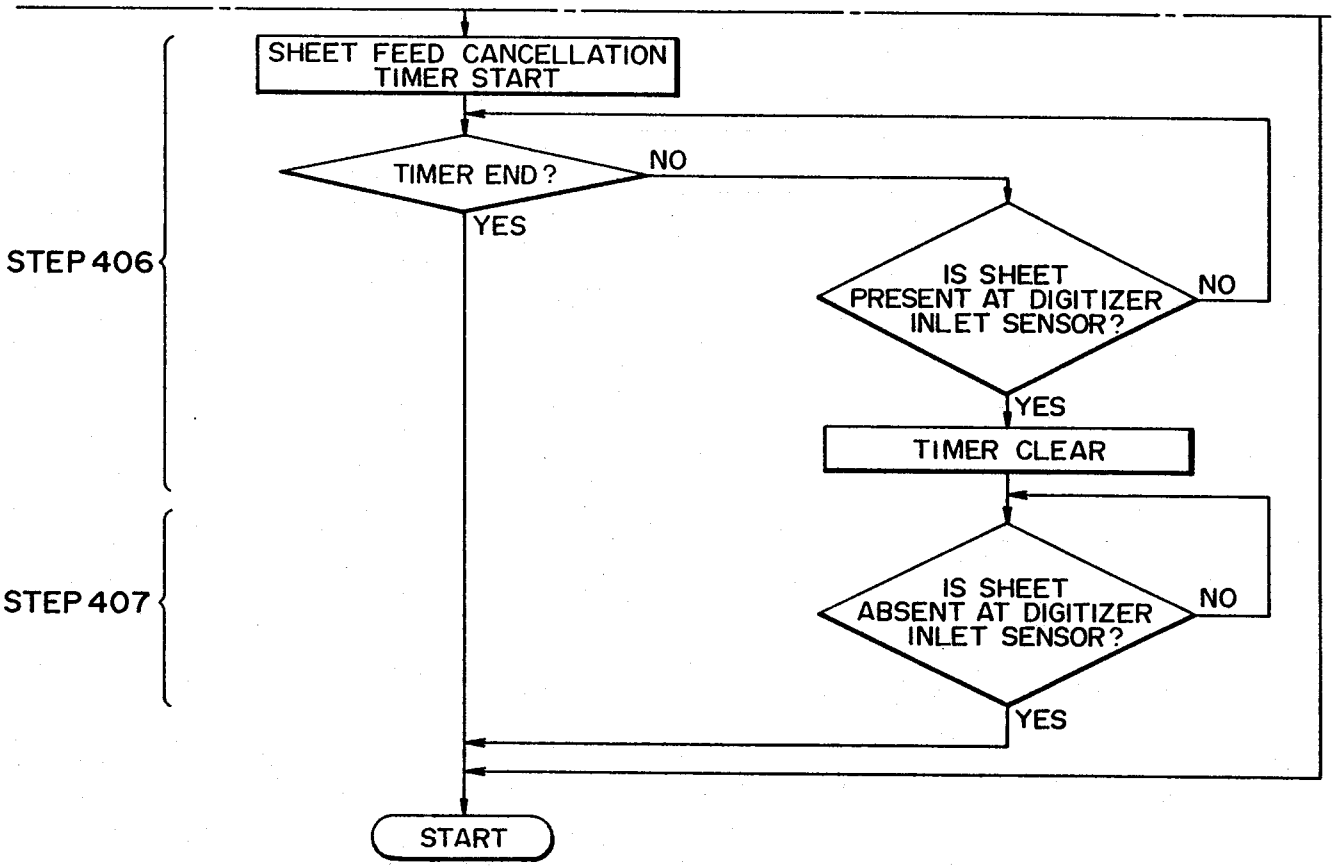

FIG. 8 is a flow chart for eliminating the above failure.

In step 401 of the flow chart in FIG. 8, the opening/closing detection sensor 28 detects opening or closing of the digitizer cover of the DF. The controller then determines whether the digitizer or DF mode is set. When the cover is open, the digitizer mode is set. In this case, the digitizer inlet is selected and the controller checks whether the sheet is set at the digitizer inlet sensor 22. However, if the cover is closed, the controller selects the normal DF inlet in the DF mode to detect a sheet at the DF inlet sensor 3. If each sheet is detected, the flow advances to step 402 and sheet feeding is started. This operation is not directly associated with the present invention, and a detailed operation thereof will be omitted. However, briefly speaking, the drive motor for the belt 7 and the rollers 4 and 5 is turned on to feed the sheet from the belt 7 to the discharge roller 11. When the sheet reaches the outlet sensor 13, the motor is rotated in the reverse direction. The controller counts a predetermined number of clocks after the sheet crosses the outlet sensor 13. When a predetermined period of time corresponding to the predetermined clocks has elapsed, the motor is stopped. The sheet is stopped at the exposure position, and at the same time the copying operation is started in step 403. The controller then waits for completion of copying operation on the predetermined number of sheets. The flow advances to step 404 and discharging of the sheet is initiated. In other words, after the motor is turned on, when the outlet sensor 13 is turned off and predetermined counting is performed, i.e., the trailing end of the sheet passes through the discharge roller 11, the motor is turned off to complete discharging. The principal feature of the present invention lies in sequence control from this discharging to the next feed start timing. In this embodiment, the discharge port and the feed port have the same surface level as the digitizer surface as a tray. When the digitizer mode is set, the sheet is slid on the digitizer surface by its inertia. For this reason, the leading end of the sheet tends to reach the sensor at the feed port. When the above control is not performed, an endless sequence of discharging and feeding of a single sheet is repeated.

In order to prevent this, after discharging is completed, the digitizer opening/closing sensor 28 checks the state of the cover in step 405. The controller then determines that the cover closed state corresponds to the DF mode. The above operation does not occur, and the flow returns to the start step. The controller waits for sheet setting. However, if the cover is open, the controller determines that the digitizer mode is set. In this case, the operation in step 406 is performed. This processing is performed such that the feed port is monitored for a period slightly longer than the time required for causing the sheet to reach the feed port due to the inertia of the sheet. The predetermined period is counted by a feed cancellation timer. When the time of the timer has elapsed, the controller monitors the digitizer inlet sensor 22. If the detection signal is output from the sensor 22 within the predetermined period, the controller determines that the sheet has reached the sensor 22. The timer is then cleared and the flow advances to step 407. In this state, the detected sheet is pulled by the hand of the operator. In other words, the controller waits for turn-off operation of the digitizer inlet sensor 28. When the sensor 28 is turned off, the flow returns to the beginning. The controller then waits for sheet setting. The above-mentioned endless operation can be apparently prevented. However, if the sensor is not turned on in step 406 until the time of the timer has elapsed, the controller determines that the operation failure described above did not occur, and the timer is rendered inoperative. The flow then returns to the beginning.

In this embodiment, the cycle of feeding and copying is initiated upon setting of a sheet. However, feeding of the first sheet may be initiated upon operation of the set and copy keys and feeding of the second and subsequent sheets may be started when they are set within a predetermined timer time after the completion of discharging if (predetermined timer time)>(feed cancellation timer time) is given. This scheme also achieves the objects of the present invention.

With the above arrangement, damage to the original caused by accidental feeding can be prevented, thereby improving system reliability.

Figure 9:
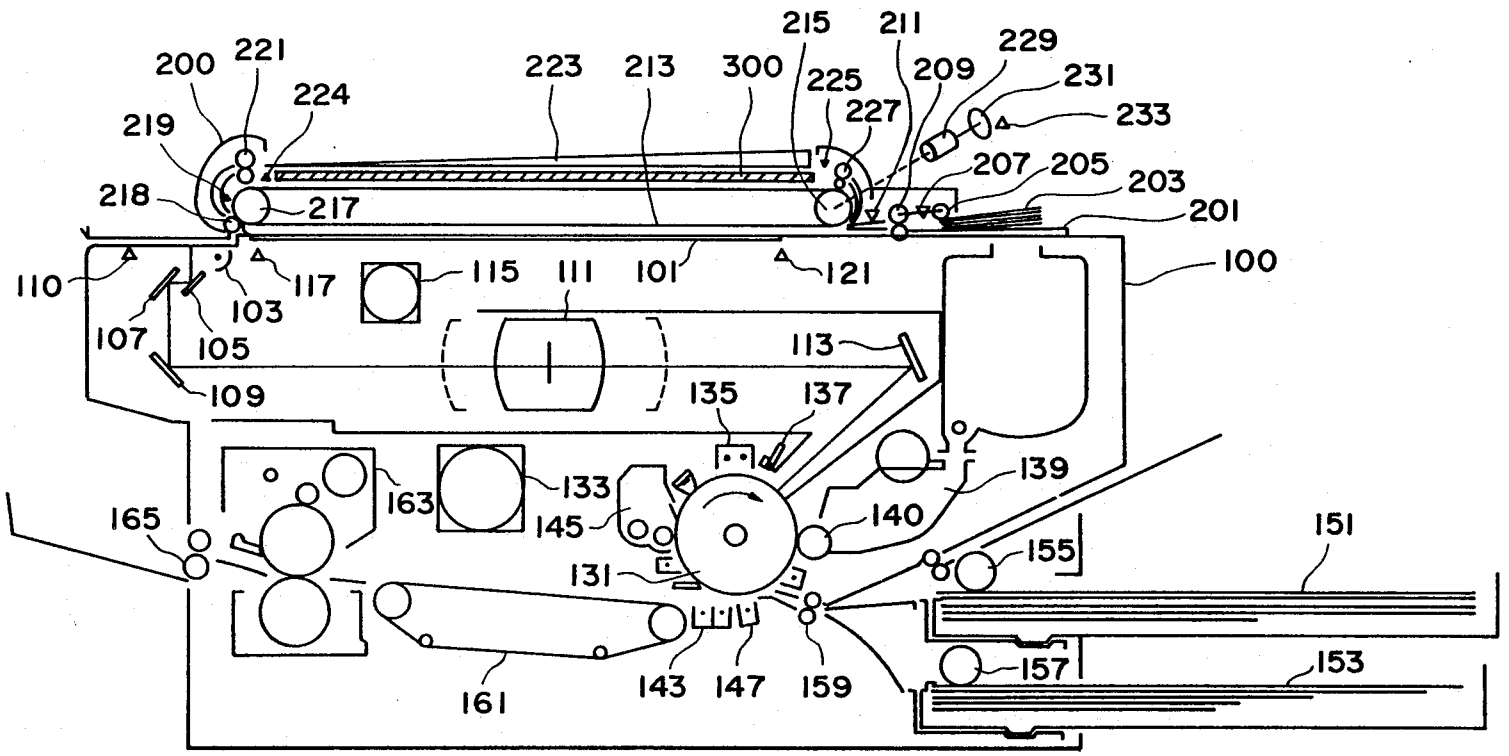
FIG. 9 is a schematic view showing a connecting state wherein an original handling apparatus (ADF or Automatic Document Feeder) of still another embodiment of the present invention is connected to a copying machine.

FIG. 9 shows still another embodiment of the present invention. In this embodiment, the original handling apparatus includes a digitizer feed port capable of receiving only one original and a feed port capable of feeding originals one by one. The arrangement of this embodiment will be described below.

FIG. 9 shows an internal arrangement when the original handling apparatus according to the present invention is connected to an image recording apparatus. Referring to FIG. 9, this system comprises a copying machine 100 having both the image reading and recording functions, an original feed apparatus (to be referred to as an ADF hereinafter) 200 for automatically feeding an original, and a digitizer 300 for designating an image area.

The copying machine 100 includes an original glass plate 101, an illumination lamp (exposure lamp) 103 for illuminating an original, scanning reflecting mirrors (scanning mirrors) 105, 107, and 109 for changing the optical path of the light reflected by the original, a lens 111 having both the focusing and variable magnification functions, a fourth reflecting mirror (scanning mirror) 113 for changing the optical path, an optical system drive motor 115 for driving an optical system, and sensors 117, 119, and 121.

The copying machine 100 also includes a photosensitive drum 131, a main motor 133 for driving the photosensitive drum 131, a high-voltage unit 135, a blanking exposure unit 137, a developing unit 139, a transfer charger 141, a separation charger 143, and a cleaning unit 145. The copying machine 100 further includes an upper cassette 151, a lower cassette 153, feed rollers 155 and 157, and register rollers 159. A conveyor belt 161 is designed to feed a recording paper sheet having an image thereon to a fixing unit 163. The fixing unit 163 fixes the image on the recording sheet by thermal compression. A sensor 167 is designed to be used for two-side copying.

The surface layer of the photosensitive drum 131 comprises a photoconductive body and a seamless photosensitive body using a conductor. The drum 131 is rotatably supported and is driven by the main motor 133 in a direction indicated by an arrow upon depression of a copy start key (to be described later). When predetermined rotation control and potential control (preprocessing) of the drum 131 are completed, the original placed on the original glass plate 101 is illuminated by the illumination lamp 103 arranged integrally with the first scanning mirror 105. Light reflected by the original is focused on the drum 131 through the first scanning mirror 105, the second scanning mirror 107, the third scanning mirror 109, the lens 111, and the fourth scanning mirror 113.

The drum 131 is corona-charged by the high-voltage unit 135. Thereafter, the image (original image) formed with illumination of the lamp 103 is slit-exposed, and a latent image is formed on the drum 131 according to a known NP scheme.

The latent image on the photosensitive drum 131 is developed by a developing roller 140 of the developing unit 139 and is visualized as a toner image. The toner image is transferred onto a transfer sheet by the transfer charger 141 (to be described later).

A transfer sheet in the upper or lower cassette 151 or 153 is fed inside the copying machine by the feed rollers 155 or 157. The sheet is aligned by the register rollers 159 at an accurate timing so that the leading end of the latent image is aligned with the leading end of the transfer sheet. Thereafter, the transfer sheet passes between the transfer charger 141 and the drum 131, and the toner image is transferred from the surface of the drum 131 to the transfer sheet. Thereafter, the transfer sheet is separated by the separation charger 143 from the surface of the drum 131. The sheet is then conveyed to the fixing unit 163 along the conveyor belt 161. The image on the sheet is compressed, heated, and fixed by the fixing unit 163. The sheet is then discharged by the discharge roller 165 outside the copying machine 100.

After the transfer cycle, the drum 131 is continuously rotated and the surface thereof is cleaned by the cleaning unit 145 comprising a cleaning roller and an elastic blade.

The arrangement of the ADF 200 will be described below. The ADF 200 includes an inlet tray 201 on which sheet-like originals 203 are placed The originals are detected by an original sensor 207. A pickup roller 205 picks up the uppermost original by vertical movement upon operation of a solenoid (not shown). A separation feed roller 209 is rotated by a roller drive motor (not shown) so that feeding of the sheet is started. When a sheet inlet sensor 211 located on the downstream side of the roller 209 detects the sheet, the pickup roller is moved upward, and drive and turn rollers 215 and 217 are driven by a belt drive motor 229 so as to initiate feeding (to be referred to as an AF operation hereinafter) of the sheet by means of an endless belt 213. The sheet is fed between the original glass plate 101 and the endless belt 213 and passes through an exposure position 117. The sheet is inserted between outlet rollers 218. When the distal end of the sheet is detected by a sheet outlet sensor 219, the endless belt 213 is temporarily stopped and then driven in the reversal direction. When predetermined counting is performed upon detection of the trailing end of the sheet, the belt 213 is stopped and the sheet is stopped at the exposure position 117. The predetermined counting is performed by causing a clock disk 231 and a sensor 233 to count clock pulses generated upon rotation of the drive motor 229. When the drive motor 229 is turned on to drive the belt 213 and the outlet and discharge rollers 218 and 221, the exposed sheet is discharged on the upper surface of the ADF. At the same time, if a sheet is present on the inlet tray 201, the next feed cycle is started. In the ADF 200, the known digitizer 300 is mounted on the upper surface of the ADF 200. A cover 223 covers the entire surface of the digitizer 300 when the cover 223 is closed. A cover opening/closing sensor 224 is arranged on the cover. A feed port is formed at the upper right portion of the ADF 200 to feed the original to the digitizer. When the cover is closed, the feed port is concealed. However, when the cover is open, the feed port is exposed. When an original is set on the digitizer feed port, a digitizer sheet inlet sensor 225 detects the sheet and the belt drive motor 229 is turned on. The feed roller 227 and the belt are driven to feed (to be referred to as a DF operation hereinafter) the sheet onto the glass plate Therefore, the sheet is stopped at the exposure position, as described above.

It should be noted that an arrangement of the digitizer 300 and a method of designating an area are the same as those in the previous embodiment, and a detailed description thereof will be omitted.

Figure 10:
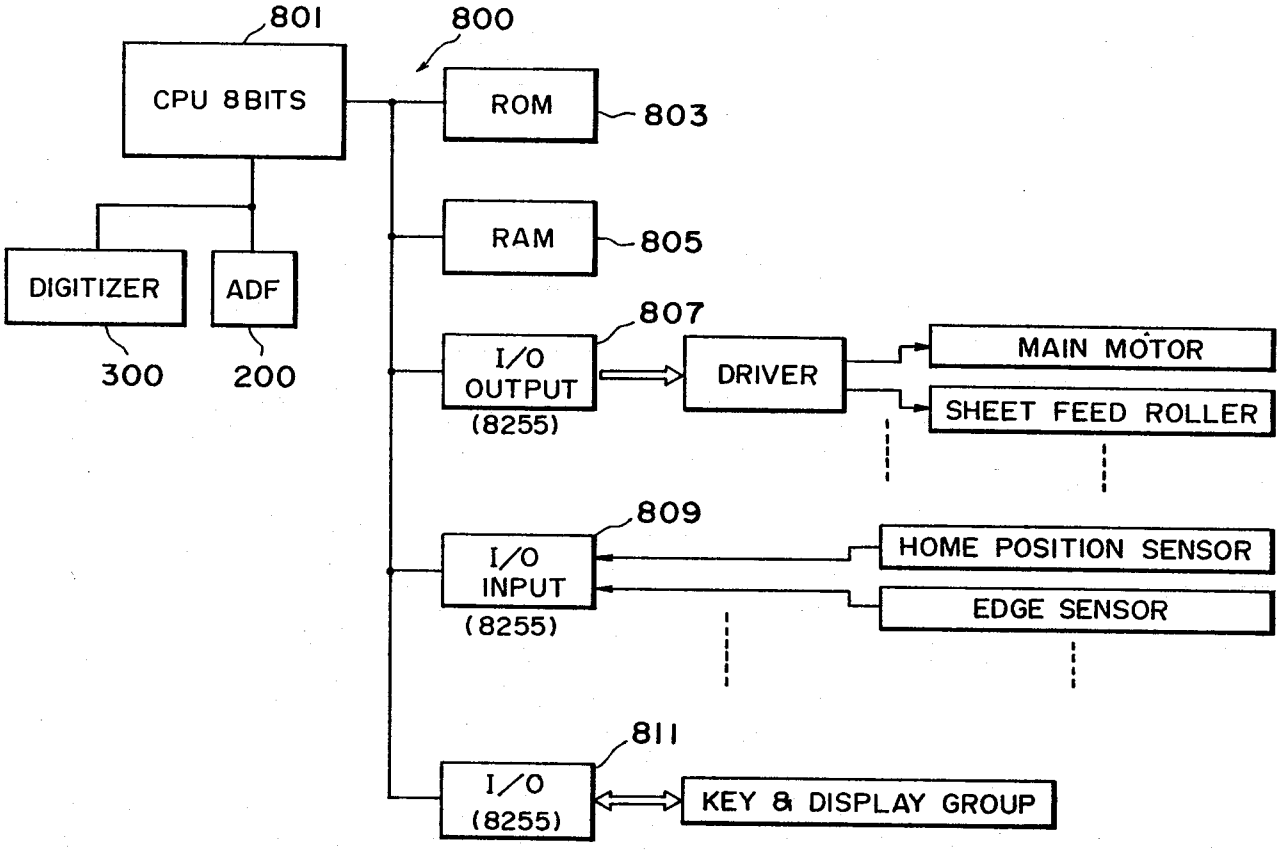
FIG. 10 is a block diagram of a control section of the system shown in FIG. 8.

FIG. 10 shows an arrangement of a controller of the embodiment shown in FIG. 1 Referring to FIG. 10, the controller includes a central processing unit (CPU) 801 for performing arithmetic operations and control and comprises a μCOM876D available from NEC Corp. The CPU 801 is connected to a read-only memory (ROM) 803 for storing control sequences (control programs) shown in FIG. 11 and the subsequent drawings. The CPU 801 controls the components connected thereto through a bus according to the control sequences stored in the ROM 803. The CPU 801 is also connected to a random access memory (RAM) 805 for storing input data. The RAM 805 serves as a working memory area.

The CPU 801 is connected to an interface (I/O) 807 for outputting a CPU 801 control signal to a load such as a main motor 133, an interface 809 for receiving an input signal from an image leading end detection sensor 121 or the like and sending it to the CPU 801, and an interface 811 for controlling the input/output operations between the CPU 801 and keys and displays (not shown). These interfaces 807, 809, and 811 use an I/O port μPD8255 available from NEC Corp.

The μCOM87AD is connected to the ADF 200 and the digitizer 300 and controls the corresponding loads and sensors.

Figure 11:
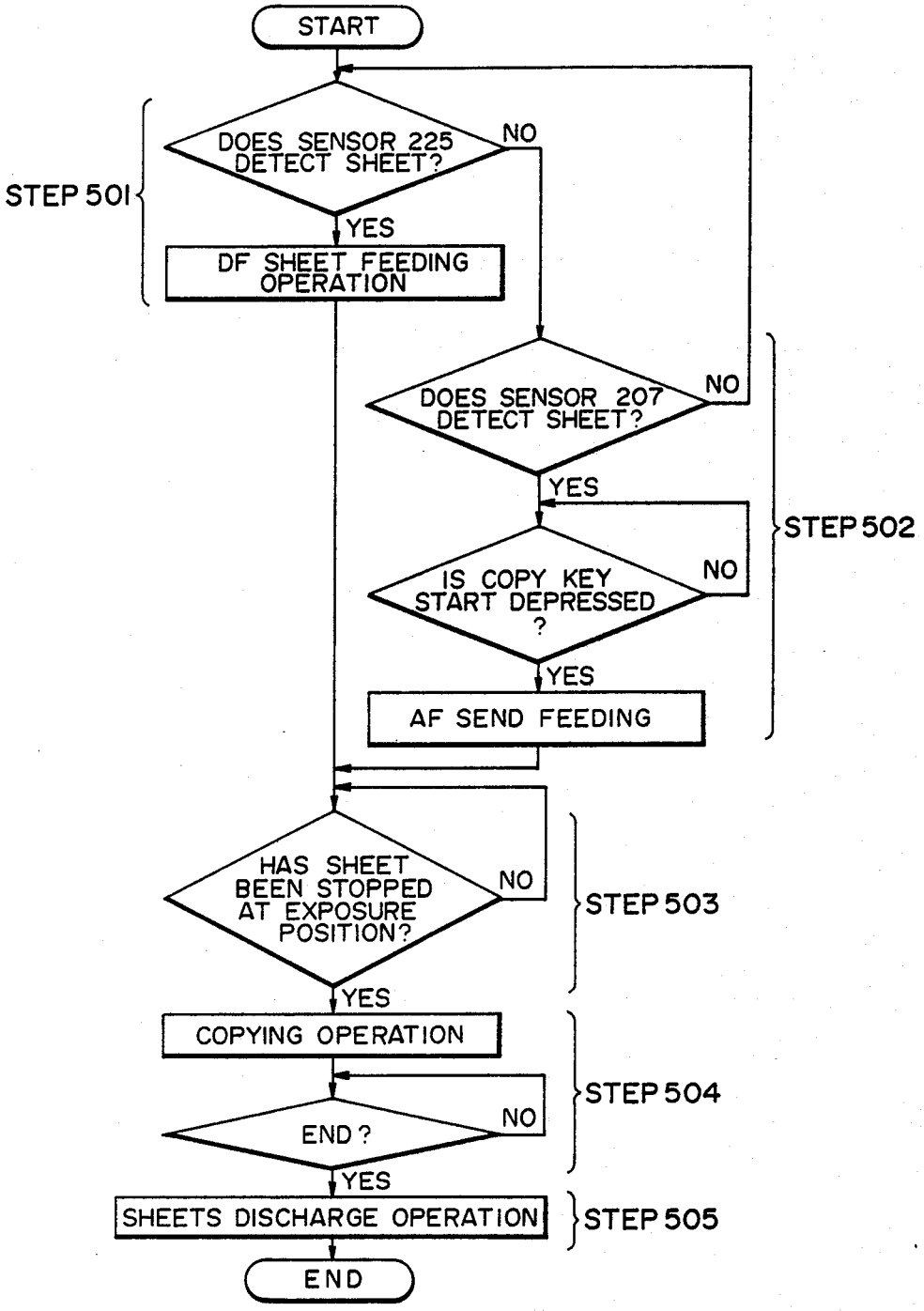
FIG. 11 is a flow chart for explaining control operation of the ADF shown in FIG. 9.

The operation of the embodiment described above will be described with reference to the flow chart in FIG. 11. The CPU 801 determines in step 501 whether the digitizer sheet inlet sensor 225 detects the sheet. If YES in step 501, feeding of the sheet from the digitizer feed port is started. When the operator sets the sheet in the digitizer sheet feed port, sheet feeding is started. The operator need not depress the copy key. In addition, the digitizer sheet feed port is a semi-automatic original feed port in which sheets are set one by one. Therefore, the operator, for example, can hold a bundle of sheets in the left hand and can set two sheets by the right hand, thus preventing confusion.

When the sensor 225 does not detect the sheet, i.e., if NO in step 501, the flow advances to step 502. The CPU 801 determines in step 502 whether the sheet sensor 207 detects a bundle of sheets. If YES in step 502, the CPU 801 waits for depression of the copy start key. When the sensor is turned on and the copy start key is depressed, the AF feed operation is started. In other words, the sheets are fed one by one. The above operation is performed due to the following reason. Since the operator sets a bundle of sheets on the tray, it takes a long period of time and feeding of sheets being set thereon may be automatically started to cause ramp feeding or paper jam. Therefore, after the operator properly sets a bundle of sheets and depresses the copy start key, feeding of the sheets is started to assure better operation procedures. In step 503, the sheet is stopped at a predetermined position of the platen glass plate. In step 504, copying operation is performed. In step 505, discharging is performed. These operations are known, and a detailed description thereof will be omitted.

In the semi-automatic original feed mode, feeding of the sheets is initiated upon its setting. In the automatic original feed mode, feeding is initiated after the originals are set and the start key is depressed, thereby improving operability.

This embodiment has exemplified an original handling apparatus having a digitizer. However, the present invention is also applicable to an original handling apparatus without a digitizer.

In the above embodiment, the original handling apparatus is applied to a copying machine. However, the present invention is not limited to this. The present invention is also applicable to any apparatus for reading an original although the apparatus does not perform recording.

What is claimed is:

1. An original handling apparatus comprising:

first original feeding means, having an area designating means for designating an arbitrary area of an original and cover means for covering and uncovering said area designating means, for feeding a set original to a predetermined position;

second original feeding means for feeding the set original to the predetermined position; and selecting means for selecting one of said first and second original feeding means, wherein said selecting means comprises detecting means for detecting the open/closed state of said cover means such that when said detecting means detects an open state of said cover means said first original feeding means feeds the set original and when said detecting means detects a closed state of said cover means said second original feeding means feeds the set original.

2. An original handling apparatus comprising:

area designating means for designating an arbitrary area of an original placed thereon;

signal generating means for generating a signal representing an end of area designation by said area designating means;

feeding means for feeding the original, after being subjected to area designation by said area designating means, to a predetermined position; and control means for enabling said feeding means to perform original feeding in response to the signal generated by said signal generating means.

3. An apparatus according to claim 2, further comprising carrying means for carrying the original such that an image surface faces up.

4. An apparatus according to claim 3, wherein said carrying means comprises a digitizer, and said area designating means performs area designation upon depression of an electrode surface of said digitizer.

5. An original handling apparatus comprising:

area designating means for designating an arbitrary area of an original;

feeding means for feeding to a predetermined position an original whose arbitrary area is designated by said area designating means;

cover means for covering said area designating means;

detecting means for detecting opening/closing of said cover means; and control means for causing said detecting means to detect an open state of said cover means and enabling said area designating means to designate the arbitrary area, and for causing said detecting means to detect a closed state of said cover means and inhibiting area designation by said area designating means.

6. An apparatus according to claim 5, wherein said area designating means comprises a digitizer and a press member for pressing an electrode surface of said digitizer.

7. An apparatus according to claim 6 wherein said press member performs area designation while the original with the image surface facing up is placed on said digitizer.

8. An original handling apparatus comprising:

area designating means for designating an arbitrary area of an original;

feeding means for feeding to a predetermined position an original whose arbitrary area is designated by said area designating means;

processing means for performing predetermined processing for the original fed to the predetermined position according to the arbitrary area designated by said area designating means; and control means for controlling said area designating means so as to allow said area designating means to perform area designation of a next original prior to an end of processing of said processing means.

9. An apparatus according to claim 8, wherein said area designation means comprises a digitizer and a press member for depressing an electrode surface of said digitizer.

10. An apparatus according to claim 8, wherein said processing means comprises copying means for forming a copy image on a sheet according to an image of the original.

11. An apparatus according to claim 8, wherein the predetermined position is an exposure position of the original.

12. An original handling apparatus comprising:

area designating means for designating an arbitrary area of an original;

feeding means for feeding to a predetermined position an original whose arbitrary area is designated by said area designating means;

processing means for performing predetermined processing for the original fed to the predetermined position according to the arbitrary area designated by said area designating means; and control means for controlling said processing means so as to perform the predetermined processing for a plurality of originals according to the arbitrary area once designated by said area designating means.

13. An apparatus according to claim 12, wherein said area designating means comprises a digitizer and a press member for depressing an electrode surface of said digitizer.

14. An apparatus according to claim 12, wherein said control means comprises mode designating means for designating a continuation mode for causing said processing means to perform the predetermined processing for the plurality of originals according to the arbitrary area once deisgnated by said area designating means, storage means for storing data representing the continuation mode set by said mode designating means, and reset means for resetting said storage means.

15. An apparatus according to claim 14, wherein said area designating means comprises a digitizer, a press member for depressing an electrode surface of said digitizer, and openable cover means for covering said digitizer, and said reset means resets said storage means in accordance with opening/closing of said cover means.

16. An apparatus according to claim 15, wherein said reset means resets said storage means upon detection of a closed state of said cover means.

17. An apparatus according to claim 14, wherein said area designating means comprises a digitizer and a press member for depressing an electrode surface of said digitizer, and said reset means resets said storage means in response to a predetermined input from said digitizer.

18. An original handling apparatus comprising:

area designating means for designating an arbitrary area of an original;

original feeding means operative in a first original feed mode for feeding an original to a predetermined position upon area designation by said area designation means and for discharging the original from the predetermined position upon completion of predetermined processing based on the area designation and a second original feed mode for feeding the original to the predetermined position and discharging the original from the predetermined position upon completion of the predetermined processing;

receiving means for receiving the original discharged from the predetermined position in a first or second reception mode; and control means for selecting the first or second reception mode according to a selection of the first or second original feed mode.

19. An apparatus according to claim 18, wherein the original is fed from different feed ports in the first and second original feed modes.

20. An apparatus according to claim 18, wherein said receiving means comprises different reception portions for operation in the first and second reception modes.

21. An original handling apparatus comprising:

first original feeding means with a stopper member;

second original feeding means without a stopper member; and control means for feeding an original from said second original feeding means first when originals are set is both said first and second original feeding means.

22. An apparatus according to claim 21, further comprising area designating means for designating an arbitrary area of the original, and wherein said first original feeding means is capable of feeding an original whose arbitrary area is designated by said area designating means.

23. An original handling apparatus comprising:

first original feeding means with a stopper member;

second original feeding means without a stopper member; and control means for controlling feeding upon setting of an original in said second original feeding means while an original is being fed by said first original feeding means.

24. An apparatus according to claim 23, wherein said control means interrupts feeding upon setting of the original in said second original feeding means whole the original is being fed by said first original feeding means.

25. An apparatus according to claim 23, wherein said first and second original feeding means feed the originals to a predetermined position and discharge the originals from the predetermined position upon completion of predetermined processing, and said control means controls to discharge all originals when the original is set in said second original feeding means during original discharging.

26. An apparatus according to claim 23, further comprising area designating means for designating an arbitrary area of an original, and wherein said first original feeding means is capable of feeding an original whose arbitrary area is designated by said area designating means.

* * * * *